United States Patent [19]

Goller et al.

[11] Patent Number: 4,720,985

[45] Date of Patent: Jan. 26, 1988

[54] YARN TENSION REGULATING DEVICE FOR KNITTING MACHINES

[75] Inventors: Ernst Goller, Reutlingen; Fritz Walker, Kusterdingen, both of Fed. Rep. of Germany

[73] Assignee: H. Stoll GmbH & Co., Fed. Rep. of Germany

[21] Appl. No.: 54,896

[22] Filed: May 28, 1987

[30] Foreign Application Priority Data

May 28, 1986 [DE] Fed. Rep. of Germany ..... 3617991

[51] Int. Cl.[4] ..... D04B 15/44

[52] U.S. Cl. ..... 66/146; 66/132 R

[58] Field of Search ..... 66/146, 132, 126, 125

[56] References Cited

U.S. PATENT DOCUMENTS 4,523,440 6/1985 Voisin et al. ..... 66/146

4,574,598 3/1986 Matthelié ..... 66/146

FOREIGN PATENT DOCUMENTS 1202803 8/1970 United Kingdom ..... 66/146

*Primary Examiner*—Ronald Feldbaum

*Attorney, Agent, or Firm*—Larson and Taylor

[57] ABSTRACT

In the yarn tension regulating device for knitting machines in which the yarn (25) runs through a yarn tension sensor (24) and a yarn brake (20) automatically adjustable in dependence upon the indication of the yarn tension sensor, there is located directly in front of the automatically adjustable yarn brake (20), in the direction of travel of the yarn, a yarn forwarding device, in particular a yarn storage feeder (13), by which the tension imparted to the yarn on its path from the yarn spool to the yarn brake is relieved. Between the yarn brake (20) and the yarn tension sensor (24), which follows it in the direction of movement of the yarn, is located a known yarn take-up (21), whereby the automatically adjustable brake (20) constitutes the yarn brake usually provided for this yarn take-up.

6 Claims, 1 Drawing Figure

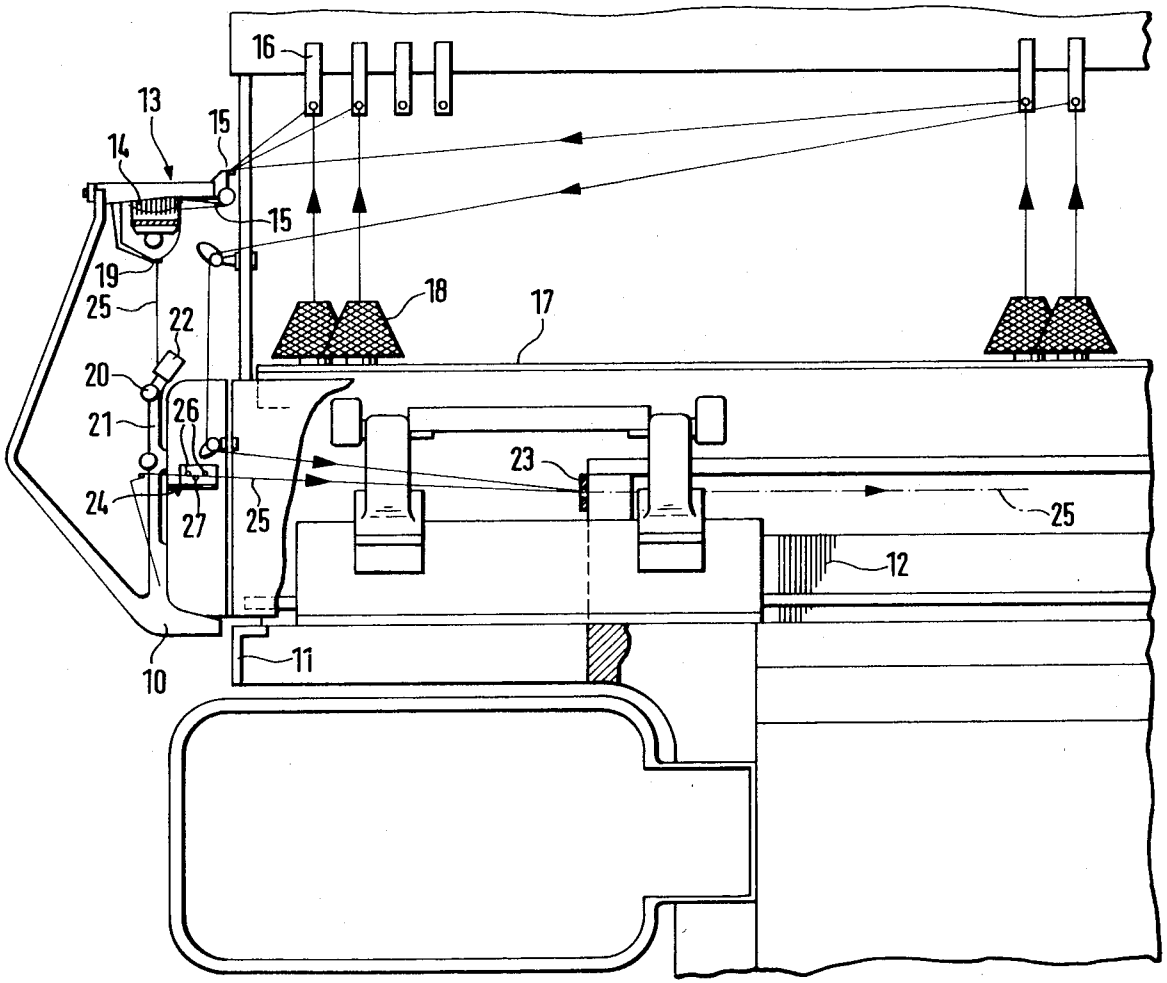
10
11
12
13
14
15
15
16
17
18
19
20
21
22
23
24
25
25
25
26
27

YARN TENSION REGULATING DEVICE FOR KNITTING MACHINES

DESCRIPTION:

The invention relates to a yarn tension regulating device for a yarn guided from a yarn spool through yarn guide members, a yarn tensioner and a yarn stop motion to the working position of a knitting machine, with a yarn tension sensor and a yarn brake which is automatically adjustable in dependence upon the indication of the yarn tension sensor.

A regulating device of the kind set out in the introduction is known, for example, from U.S. Pat. No. 4,523,440. Therein, a yarn brake is adjusted in its braking effect by means of an electric motor, whereby the motor is driven in dependence upon the indication of a yarn tension sensor either in one direction of rotation to increase the braking effect or in the other direction of rotation to reduce the braking effect. This regulation of the braking effect is intended to secure that for the same pieces of knitting the same lengths of yarn are always used so that the same measurements can always be ensured for the knitting.

It has, however, emerged that in this yarn tension regulating device, because of the numerous yarn guide members and yarn stop motions through which a yarn must be led from a yarn spool to the working position of a knitting machine, marked variations in yarn tension are introduced. These continual variations in yarn tension also cause a continual activity in the indication from the yarn tension sensor if the sensitivity is not set so low that the desired effect of the device is lost.

The problem which is the basis of the invention is to construct a yarn regulating device of the kind set out in the introduction so that a more reliable and more exact control of the braking force of the adjustable yarn brake is ensured.

The problem set forth is solved according to the invention in the yarn tension regulating device mentioned in that there is located directly in front of the automatically adjustable yarn brake, in the direction of movement of the yarn, a yarn forwarding device which relieves the tension imparted to the yarn in its path from the yarn spool to the yarn brake and in that, between the yarn brake and the yarn tension sensor located downstream of it in the direction of movement of the yarn, there is located a known yarn take-up. Advantageously, a yarn storage feeder, also known, can be provided as the yarn forwarding device.

In the yarn tension regulating device according to the invention the resistance affecting the yarn on its path from the yarn spool to the yarn brake is not apparent since this resistance is overcome by the forcible feeding of the yarn and the yarn forwarding device supplies the yarn practically tension-free to the yarn brake in conformity with the operational speed of the machine. This means that only those variations in tension must be sensed at the yarn tension sensor, which the yarn experiences in its path from the controlled yarn brake to the working position of the machine. The introduction of a yarn storage feeder thus has the advantage that the yarn forwarding device, because of the stored length of yarn, need not be switched on and off so accurately as is the case in the absence of a yarn storage device.

Advantageously, the automatically adjustable brake can at the same time constitute the yarn brake which the yarn take-up, located in front of the yarn tension sensor, must have in any case, so that in the yarn take-up operation in fact, yarn is only taken up and is not withdrawn from the yarn storage device.

The yarn tension regulating device according to the invention is especially suitable for use on flat knitting machines, in which case the automatically adjustable yarn brake is located with the lateral yarn take-up in the region of an end of a needle bed. All the parts of the yarn tension regulating device essential to the invention, namely the yarn forwarding device, the yarn tension sensor and the automatically adjustable yarn brake located with the known yarn take-up can thus be arranged on a common attachment, with which older flat knitting machines can be fitted.

It has been shown that the sensitivity of response of the regulating device can be noticeably increased if the friction of the yarn in traversing the yarn tension sensor is greatly reduced by guiding the yarn in the region of the yarn tension sensor over fixedly and movably mounted yarn guide rollers, which maintain the yarn tension experienced by the yarn in the yarn tension sensor, practically constant in every position of the movable part of the yarn tension sensor.

In the accompanying drawing there is shown, more or less schematically, the arrangement on a flat knitting machine of a yarn tension regulating device constructed in accordance with the invention.

The yarn tension regulating device shown in the drawing has a common support 10, which is securable on the machine frame 11 of a flat knitting machine in the region of the end of one of the needle beds 12. On the support 10 is secured a yarn storage feeder 13, which, for example, has a yarn storage drum 14 drivable by an electric motor and on which a predetermined length of yarn is maintained in individual windings as a reserve, which - continuously or at intervals - is drawn off through various guide members 15 and at least one yarn stop motion 16 from a yarn spool 18 located on a bobbin table 17 of the flat knitting machine. From the storage drum 14 of the yarn storage feeder 13 the stored yarn can be drawn down practically without resistance through a yarn eyelet 19 controlling direction, to where it enters a yarn brake 20 of a yarn take-up provided in known manner with a pivoted arm 21. The braking effect of the yarn brake 20 can be adjusted by an electric motor 22 which can be driven in both directions of rotation.

From the yarn take-up with the pivoted arm 21 the yarn 25 runs through a yarn tension sensor 24 of suitable construction, on its way to a yarn guide 23 and further to the working position of the flat knitting machine, not shown in greater detail. In the yarn tension sensor 24 the yarn 25 is guided over fixed yarn guide rollers 26 and over at least one yarn guide roller 27 which is movable under the influence of the yarn tension. The yarn tension sensor 24 supplies control signals dependent upon the measured tension in the yarn 25, by means of which the electric motor 22 of the automatically adjustable yarn brake 20 is operated either in one direction to increase the braking effect or in the other direction to reduce the braking effect.

Thus, at the yarn tension sensor 24 only that tension is effective, which is imparted to the yarn 25 by the operations effected on the yarn at the working position of the knitting machine and by the guiding of the yarn through the yarn brake 20 and the following yarn guide members.

We claim:

1. A yarn tension regulating device for a yarn guided from a yarn spool through yarn guide members, a yarn tensioner and a yarn stop motion to the working position of a knitting machine, with a yarn tension sensor and a yarn brake which is automatically adjustable in dependence upon the indication of the yarn tension sensor, characterised in that there is located directly in front of the automatically adjustable yarn brake (20), in the direction of movement of the yarn, a yarn forwarding device (13) which relieves the tension imparted to the yarn (25) in its path from the yarn spool (18) to the yarn brake (20), and in that, between the yarn brake (20) and the yarn tension sensor (24) which follows it in the direction of yarn movement, there is located a known yarn take-up (pivoted lever 21).

2. A yarn tension regulating device according to claim 1, characterised in that a known yarn storage feeder (13) is provided as the yarn forwarding device.

3. A yarn tension regulating device according to claim 1, characterised in that the automatically adjustable brake (20) constitutes at the same time the yarn brake usually provided for the known yarn take-up (21).

4. A yarn tension regulating device according to claim 1, for a flat knitting machine, characterised in that the yarn take-up (21) located in front of the yarn tension sensor (24) is a lateral yarn take-up located in the end region of a needle bed (12).

5. A yarn tension regulating device according to one of claims 1, characterised in that the yarn (25) coming from the yarn take-up (21) runs through the yarn tension sensor (24) over fixedly and movably mounted yarn guide rollers (26, 27).

6. A yarn tension regulating device according to claim 1, characterised in that the automatically adjustable yarn brake (20) is a known yarn brake adjustable by an electric motor controlled in both directions of rotational movement in dependence upon the indication of the yarn tension sensor (24).

* * * * *